United States Patent [19]

Hoopengardner et al.

[11] 4,439,904

[45] Apr. 3, 1984

[54] CARPET SEAMING ROLLER TOOL

[75] Inventors: Merle C. Hoopengardner, Lafayette; William B. Wenzel, Alameda, both of Calif.

[73] Assignee: Orcon Corporation, Union City, Calif.

[21] Appl. No.: 291,192

[22] Filed: Aug. 10, 1981

[51] Int. Cl.[3] ..... B30B 3/00; B22F 3/18

[52] U.S. Cl. ..... 29/110.5; 29/116 R; 29/121.2; 81/3 R; 156/304.7; 156/579

[58] Field of Search ..... 81/3 R; 29/110.5, 116 R, 29/116 AD, 121.1, 121.2, 121.3, 121.5, 124; 156/304.7, 304.4, 579

[56] References Cited

U.S. PATENT DOCUMENTS 2,693,893 11/1954 Rice et al. ..... 29/116 R X 4,224,726 9/1980 Walker ..... 29/110.5 X

FOREIGN PATENT DOCUMENTS 80213 6/1951 Norway .

*Primary Examiner*—Mark Rosenbaum

*Attorney, Agent, or Firm*—Donald C. Feix

[57] ABSTRACT

A carpet seaming roller tool for drawing two sections of carpet together in a hot melt adhesive seaming operation has two, separate, cleated rollers which are disposed side-by-side so that one roller grips one section of carpet and the other roller grips the other section of carpet as the roller tool is rolled back and forth along the seam during the seaming operation. Each roller has an axle which is mounted for rotation about a horizontal axis in its own support frame, and each support frame is mounted for a limited amount of pivotal, swinging movement (about a generally vertical axis) in a main frame associated with the handle of the carpet seaming roller tool. Because the axles are independently pivoted for a limited amount of swinging movement both forward and rearward of a position of exact axle alignment, the roller tool can be pushed and pulled along the seam while the axles automatically swing to positions which draw the two sections of carpet tightly together during both directions of movement of the carpet-roller tool.

6 Claims, 7 Drawing Figures

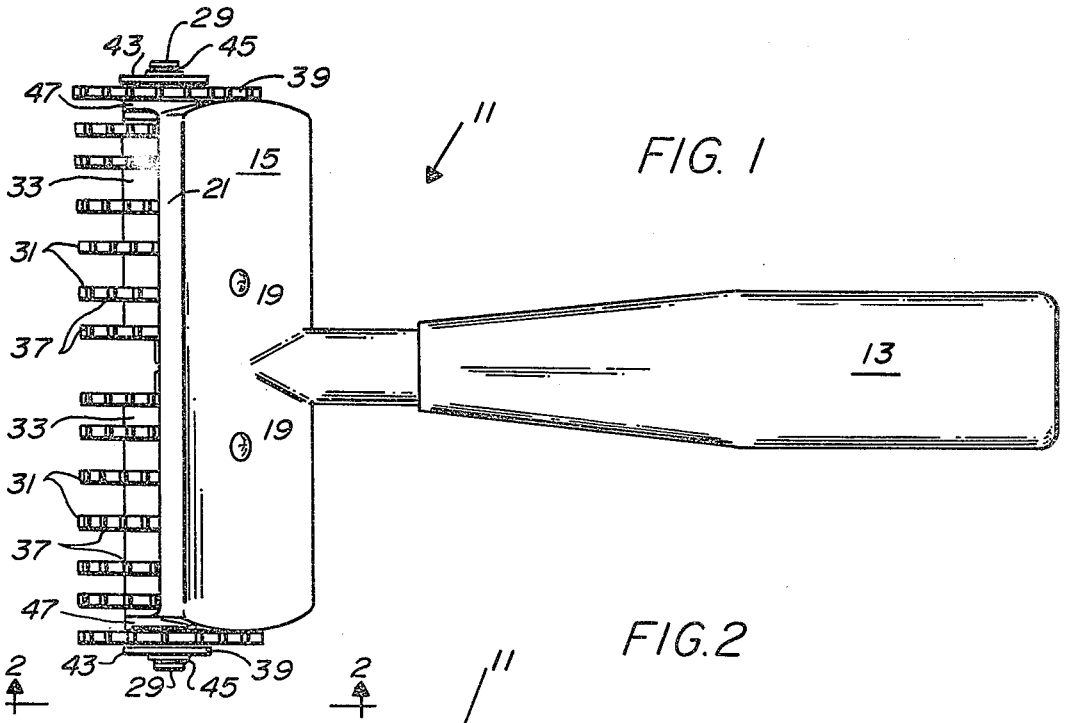
FIG. 1
FIG. 2
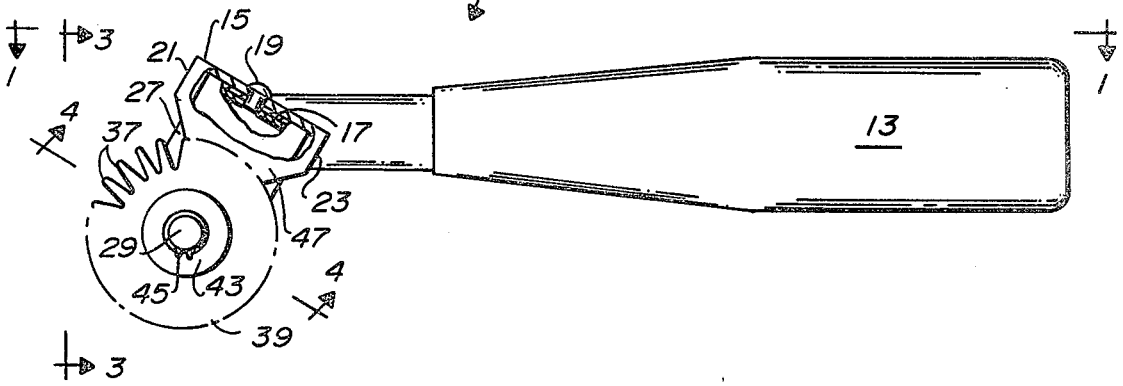
FIG. 3
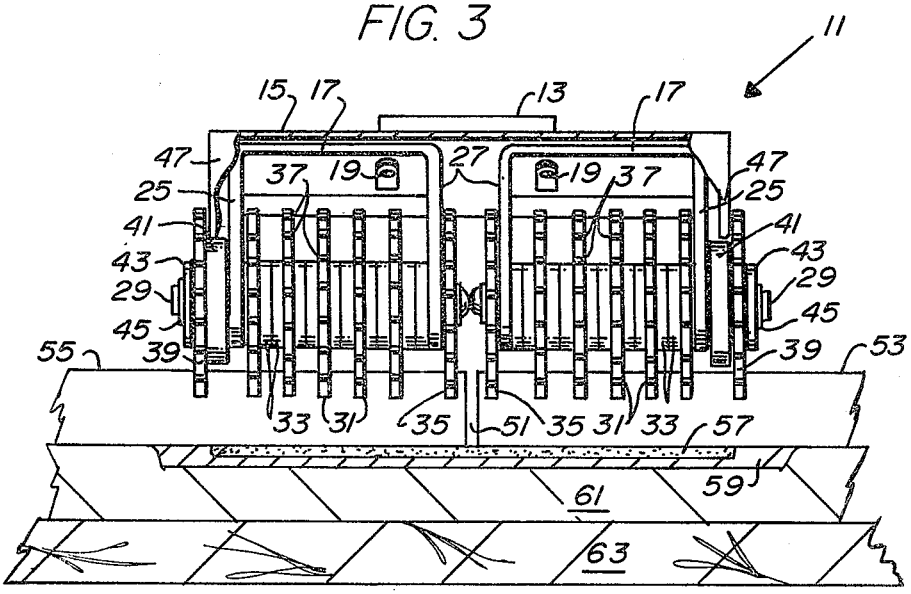

CARPET SEAMING ROLLER TOOL

BACKGROUND OF THE INVENTION

This invention relates to a carpet seaming roller tool. It relates particularly to a roller tool which is effective to draw two adjacent sections of carpet together in a hot melt adhesive seaming operation during both pushing and pulling movement of the roller tool forward and backward along the seam.

Most carpet installations are done using a hot melt carpet seaming tape in a face seaming operation. In the face seaming operation the two sections of carpet are arranged side by side, the adjacent edges of the two sections of carpet are raised up, and a tape containing a hot melt adhesive is placed beneath the edges of the two sections of the carpet to be seamed. A heating iron is moved along the upper surface of the tape to heat the hot melt adhesive to a molten state, and the lower surfaces of the carpet sections at the seam are then pressed down onto the heated, hot melt adhesive while the adhesive is in a molten or liquid state. A carpet roller tool is usually used to insure that the edges of the carpet are pressed firmly into the hot melt adhesive so that the adhesive is pressed into and around the fibers of the undersurface of the carpet to provide a strong bond between the carpet section and the adhesive and (through the adhesive and the tape) to the other section of the carpet on the opposite side of the seam.

The roller tool used in the prior art had a single, straight axle and a number of toothed discs mounted for rotation on the axle. The teeth on the discs help to penetrate through the pile of the carpet to exert pressure and traction on the woven or fibrous backing material of the carpet. The straight axle roller tool as used in the prior art thus served the primary function of pressing the two carpet sections at the seam firmly into contact with the underlying hot melt adhesive as the roller tool was rolled back and forth along and above the seam.

The seam formed in the face seaming of carpet sections is a butt joint. It is of course desirable to have a tight seam so that hot melt adhesive does not extrude up through the seam and into the pile of the carpet, because extruded adhesive could detract from the appearance of the seam.

Maintaining a tight butt seam is also important in wallpapering, and roller tools have been disclosed in that art for drawing two sections of material together in a tight butt seam at the same time that one of the sections of material is being pressed against adhesive beneath the seam. U.S. Pat. No. 2,693,893 to Rice et al shows a tool having an axle formed with two sections which are slightly inclined to one another so that rollers mounted on two sections of the axle are disposed side by side at a slight angle of inclination with respect to each other. When the tool shown on the Rice patent is moved in one direction, the angled inclination of the two rollers draws the two sections together at the seam. When the roller tool of the Rice et al patent is moved in the other direction, the angled inclination of the two rollers spreads the two sections of the material apart at the seam.

Norwegian Pat. No. 80213 also shows a roller tool having a single axle with two sections inclined at an angle with respect to one another so that rollers mounted on the axle sections produce the same drawing together or spreading apart action as the roller of the Rice et al patent. U.S. Pat. No. 4,224,726 to Walker shows a roller tool for carpet seaming operation using the axle construction of the Rice et al and Norwegian wallpaper tool patents. The Walker patent replaced the rubber rollers of the Rice and Norwegian wallpaper roller tool patents with the toothed discs of the prior art hot melt adhesive carpet seaming roller tools to enable the Walker patent roller tool to produce the same action on carpet sections as the wallpaper roller tools produced on wallpaper strips.

In carpet seaming operations the two sections of carpet are relatively heavy, and there usually is no occasion to want to move the sections apart from one another at the seam. Instead, the objective in carpet seaming is generally to maintain a tight seam. If there is any gap in the seam (because of any local variations in cutting of the edge of the carpet or whatever), the installer would want to close that gap (to prevent the extrusion of hot melt adhesive up through the gap and the detrimental effect on appearance as noted above) rather than to move the sections of carpet apart to increase the gap in the seam.

There is another problem which is peculiar to the carpet seaming operation, and that problem relates to the relatively short open time of the hot melt adhesive. A carpet installer has about four seconds in which to work the backing of the carpet sections down into the hot melt adhesive after the hot melt adhesive has been heated to a molten state. After that period of time the hot melt adhesive sets up to a stage where the fibers in the backside of the carpet section cannot be effectively pressed down into the solidifying adhesive.

This means that the carpet installer must be able to operate rapidly with the roller tool.

The roller tools shown in the Rice et al, the Norwegian and Walker patents all have a single axle with the two sections of the axle inclined at a fixed angle so that the roller tools, for purposes of drawing together of the material sections being worked, are unidirectional tools. Thus, with the Walker patent carpet seaming roller type rool the installer has to pick up the tool and carry or lift it back to the original starting point each time he wants to bring pressure to bear from the tool through the carpet to the underlying tape. This is a time consuming and generally impractical mode of operation for carpet seaming installations; and the prior art straight axle roller tool, which can be rolled back and forth along the seam without lifting from the face of the carpet, has been continued in use, even though this staight axle carpet roller tool does not produce any drawing together action on the seam.

SUMMARY OF THE INVENTION

It is a primary object of the present invention to construct a carpet seaming roller tool which can be pushed back and forth along the seam to press the carpet sections down into the hot melt adhesive and which will also draw the two sections of carpet together in a tight seam in both the forward and rearward direction of movement of the roller tool without having to lift the tool from the carpet sections as the tool is rolled back and forth along and above the seam.

A carpet seaming roller tool constructed in accordance with the present invention has two, separate cleated rollers which are disposed side-by-side so that one roller grips one section of carpet and the other roller grips the other section of carpet as the roller tool is rolled back and forth along the seam during the seaming operation.

Each roller has an axle which is mounted for rotation about a horizontal axis in its own support frame.

Each support frame is mounted for a limited amount of pivotal, swinging movement (about a generally vertical axis) in a main frame. The handle is connected to the main frame, and the pivot points for the support frames are located near the inner ends of the support frames so that the outer ends of the support frames can swing back and forth in forward and rearward directions. The outer ends of the support frames are engagable with flanges on the main frame to limit the extent of the swinging movement in both the forward and rearward direction.

The pivotal construction and the arrangement for the support frames enable the support frames and the associated rollers to immediately readjust their relative angular inclination when the direction of motion of the roller tool is changed so that the rollers automatically assume the proper relative angular inclination for drawing the two sections of carpet together during both forward and rearward rolling of the carpet tool along the seam.

As a result, the operator can keep the carpet roller tool firmly pressed down on the carpet at all times and can push and pull the tool rapidly back and forth along the seam while continuously drawing the two sections of carpet together in a tight seam.

A carpet seaming roller tool construction and mode of operation having the features described above and effective to function as described above constitute further, specific objects of the present invention.

Other and further objects of the present invention will be apparent from the following description and claims and are illustrated in the accompanying drawings which, by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWINGS

FIG. 1 is a top plan view of a bidirectional carpet seaming roller tool constructed in accordance with one embodiment of the invention. In FIG. 1 the axles of the two side-by-side rollers are shown in general alignment. In actual use the axles and associated rollers swing to the phantom outline positions shown in FIG. 4 as the roller tool is pushed and pulled forward and backward along the seam.

FIG. 2 is a side elevation view (partially broken away to show details of construction) of the carpet seaming roller tool of FIG. 1.

FIG. 3 is a front elevation view of the carpet seaming roller taken along the line and in the direction indicated by the arrows 3—3 in FIG. 2. FIG. 3 is also partly broken away to show details of construction.

FIG. 4 is taken along the line and in the direction indicated by the arrows 4—4 in FIG. 2.

DESCRIPTION OF THE PREFERRED EMBODIMENTS

Figure 4:
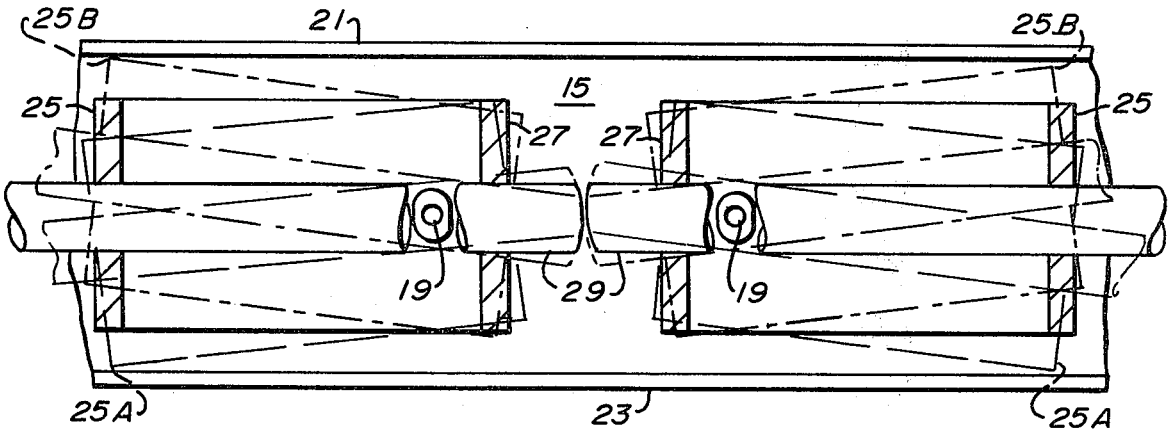
FIG. 4 is a partial bottom view of the carpet seaming roller, diagramtically indicating the range of pivoting motion of the roller support frames and swinging movement of the associated roller axles.

A carpet seaming roller tool constructed in accordance with one embodiment of the present invention is indicated generally by the reference numeral 11 in FIG. 1.

The tool 11 is constructed to draw two sections of carpet together at a seam in a hot melt seaming operation as the tool 11 is rolled back and forth along the seam on the upper surface of the two sections of carpet. The tool 11 presses the backs of the carpet sections into the hot melt adhesive of the carpet seaming tape after the hot melt adhesive has been heated to a molten state by a heated iron. There is only a relatively short period of time (in the order of four to five seconds) that the hot melt adhesive remains in the open phase after the adhesive has been heated by the iron, so the installer has to work fairly quickly to get the carpet backing properly pressed down into the hot melt adhesive while the adhesive is still in this open phase.

The tool 11 of the present invention is constructed to permit the installer to rapidly make repeated passes back and forth with the tool along the seam without lifting the tool from the carpet, and the tool is also effective to draw the two sections of carpet together in both the forward and rearward direction of movement of the tool along the seam.

The tool 11 thus provides the multiple function of not only pressing down the carpet backing into the hot melt adhesive while the adhesive is still open but also drawing the sections of carpet together into a tight butt seam in both directions of movement of the roller tool.

The way in which the roller tool 11 of the present invention is constructed to achieve this very desirable drawing action in both directions of motion will now be described in detail below with specific reference to the drawings.

The roller tool 11 of the present invention has two separate rollers, and each of the rollers is mounted for a limited amount of swinging movement to automatically produce the desired drawing together action of the carpet sections at the seam. The carpet installer does not have to be concerned about the direction of movement of the roller tool and can roll the tool back and forth rapidly while the adhesive is still in a molten, open state. The two rollers of the roller tool automatically shift position with each change of direction of the roller tool to produce the desired drawing together action in both directions of movement of the roller tool.

As illustrated in FIGS. 1 and 2, the roller tool 11 includes a handle 13 and a main frame 15 attached rigidly to the handle 13.

A pair of generally U-shaped roller support frames 17 are attached to the main frame 15 by pivot members 19 near the inner ends of the support frames 17 so that the outer ends of the support frames 17 can swing back and forth between the positions 25A and 25B illustrated in the phantom outline in FIG. 4 through a range of 8 to 12 degrees.

As best illustrated in FIGS. 4, 1 and 3, the main frame 15 has a downwardly projecting flange 21 which extends along the front of the main frame and a downwardly projecting flange 23 which extends along the backside of the main frame 15.

Each U-shaped support frame 17 has a downwardly projecting leg 25 at its outer end, and the forward and rearward edges of this leg 25 engage the respective forward and rearward flanges 21 and 23 of the main frame 15 to limit the total amount of forward and rearward swinging movement of the outer ends of the support frames 17 about the pivot pins 19.

The pivot pins 19, in a specific embodiment of the present invention, comprise a bolt and nut assembly; but other pivotal connector construction, such as, for example, a riveted construction, can be used.

Figure 5:
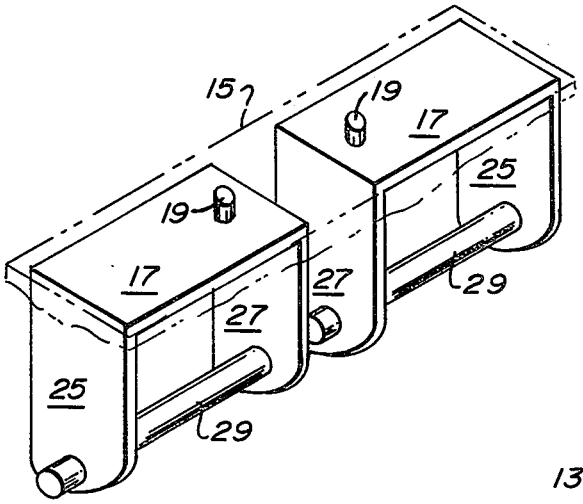
FIG. 5 is a perspective view showing only the roller shafts and associated support frames. Each support frame is mounted for pivoting movement (about pivot pins 19) with respect to the main frame (shown in phantom lines) of the roller tool.

As best shown in FIG. 5 each U-shaped roller support frame has a downwardly projecting leg 27 at the inner end of the support frame.

Each support frame 17 has an axle 29 mounted for rotation within the lower end portions of the legs 25 and 27.

As best shown in FIG. 1 through 3, a number of discs 31 are mounted for rotation on the part of each axle 29 extending between the legs 25 and 27. Each disc 31 has radially projecting teeth 37 at the periphery of projecting down through the pile to grip into the main body of the carpet.

The discs 31 are spaced apart from each other and from the legs 25 and 27 by spacer washers 33.

In a specific embodiment of the present invention the thickness of the washers 33 is such as to permit a limited amount of rocking movement of the tooth discs 31 on the axles 29.

Also, in a specific embodiment of the present invention, an additional toothed disc 35 is mounted on the inner end of each axle 29 inside the inner leg 27. A snap ring 37 retains the inner end of its associated axle in place.

In a specific embodiment of the present invention a disc 39 is positioned outwardly of the leg 25 by a spacer disc 41. A washer 43 and a snap ring 45 retain the disc 39 and outer end of the axle 29 in position with respect to the outer leg 25 of the support frame.

The spacer washer 41, in a preferred embodiment of the present invention, also serves as a bearing wheel for transferring vertical loads from the outer end of the axle 29 to the main frame 17 so that this end of the axle can swing freely within the range of movement shown in FIG. 4 as the roller tool 11 is pushed back and forth along the seam.

Each outer end of the main frame has a downwardly extending flange 47 (see FIG. 3), and the lower edge of the flange 43 engages the upper periphery of the bearing wheel 41 to prevent the upper surface of the support frame from binding against the related lower surface of the main frame 15.

FIG. 3 shows, in somewhat schematic form, the tool 11 in the process of closing a seam 51 between two sections of carpet 53 and 55 while pressing the carpet backing down into a layer of molten hot melt adhesive 57 of a carpet seaming tape 59 disposed beneath the seam 51 and on top of a carpet underlay or pad 61 on a floor 63.

Figure 6:
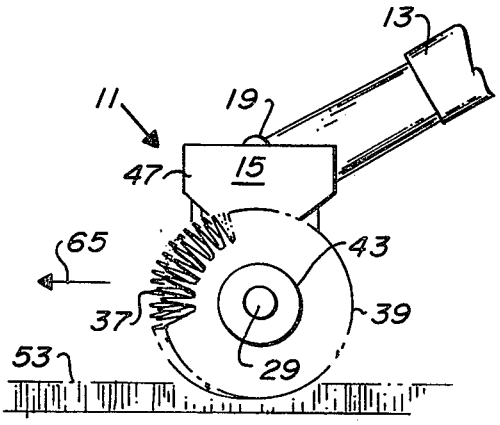
FIG. 6 is a partial side elevation of the roller tool showing how the outer ends of the axles swing back behind the inner ends of the axles as the roller tool is pushed forward (in the direction of the arrow) to draw the two sections of carpet together at the seam.
Figure 7:
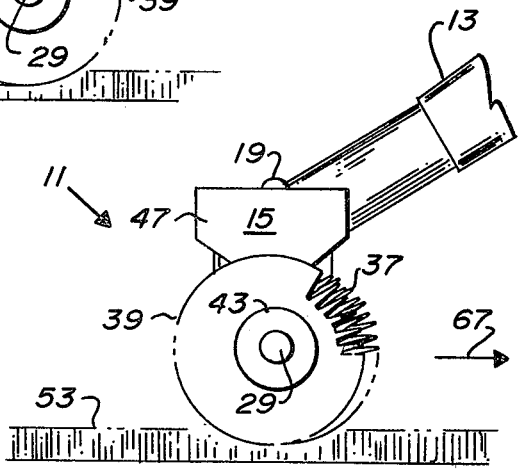
FIG. 7 is a view similar to FIG. 6, but shows the tool being pulled backward (in the direction of the arrow). In this mode of operation the outer ends of the axles swing forward ahead of the inner ends of the axles to cause the roller tool to also draw the two sections of the carpet together at the seam in this direction of tool movement.

FIGS. 6, 7 and 4 also show the tool 11 in use.

As the tool 11 is pushed forward in the direction indicated by the arrow 65 in FIG. 6, the outer ends 25 of the support frames 17 swing backward to the position indicated at 25A in FIG. 4 to draw the two sections of carpet tightly together in a butt joint and to close the seam 51.

When the direction of movement of the tool 11 is reversed, and the tool 11 is pulled backward in the direction indicated by the arrow 67 in FIG. 7, the outer ends 25 of the support frames 17 swing forward to the positions indicated at 25B in FIG. 4 so that the two rollers of the tool 11 continue to draw the carpet seam tightly together in this pulling direction of movement of the tool 11 also.

The tool 11 of the present invention thus operates automatically to adjust the relative angles of inclination of the side-by-side rollers with each reversal in the direction of motion of the tool 11. This permits the carpet installer to work the seam very rapidly by back and forth movement of the tool during the relatively short period of time in which the hot melt adhesive remains in a molten, open state before solidifying and setting up.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

We claim:

1. A bi-directional carpet seaming roller tool for drawing two sections of carpet together at a seam during a hot melt seaming operation in which a hot melt adhesive on a carpet seaming tape has been heated to a molten state by a heated iron, said roller tool being constructed to continuously press the edges of the carpet sections down into the hot melt adhesive during both pushing and pulling movement of the roller tool forward and backward along the seam and to thereby permit the carpet installer to work quickly to get the carpet backing properly pressed down into the hot melt adhesive during the relatively short period of time that the hot melt adhesive remains in the open phase after the heating by the iron and before the hot melt adhesive cools down to a condition in which the carpet backing cannot be properly pressed into the rapidly solidfying hot melt adhesive, said roller tool comprising, a main frame, a handle connected to the main frame, first and second rollers disposed side-by-side so that one roller grips one section of carpet and the other roller grips the other section of carpet as the roller tool is rolled back and forth along the seam, and mounting means mounting each roller for swinging movement of the outer end of the roller backward and forward with respect to the inner end of the roller and effective to cause the rollers to automatically swing to positions which draw the two sections of carpet together at the seam during movement of the tool along the seam in both the pushing direction and the pulling direction, said mounting means including pivot means for each roller located inwardly of the mid point of the roller and providing a generally vertical axis for said swinging movement of the roller so that the outer end of the roller can swing back and forth in forward and rearward directions with pulling and pushing movement of the roller tool backward and forward along the seam.

2. The invention defined in claim 1 wherein the mounting means include a support frame for each roller and the pivot means connect the support frame to the main frame.

3. The invention defined in claim 2 wherein the main frame includes limiting means engagable with the outer ends of the support frames for limiting the extent of the forward and rearward swinging movement of the rollers.

4. The invention defined in claim 3 wherein the angles of swinging movement forward and rearward of a position of alignment of the two rollers are substantially equal.

5. The invention defined in claim 4 wherein the angles of swinging movement forward and rearward of the position of alignment of the rollers are in a range of 8 to 12 degrees.

6. The invention defined in claim 2 wherein each roller includes an axle mounted for rotation within its associated support frame and a plurality of toothed discs mounted on the axle and including bearing means at the outer end of each shaft and associated with the associated outer end of the main frame for transferring vertical loads from the outer end of the axle to the main frame so that the end of the axle can swing freely without any binding of the support frame against the main frame.

* * * * *